US007018347B2

(12) United States Patent
Kim

(10) Patent No.: US 7,018,347 B2
(45) Date of Patent: Mar. 28, 2006

(54) LIE-DOWN MASSAGER

(76) Inventor: Hakjin Kim, 610 Ridgeview Ct., Diamond Bar, CA (US) 91765

( * ) Notice: Subject to any disclaimer, the term of this patent is extended or adjusted under 35 U.S.C. 154(b) by 371 days.

(21) Appl. No.: 10/249,989

(22) Filed: May 23, 2003

(65) Prior Publication Data

US 2004/0236256 A1 Nov. 25, 2004

(51) Int. Cl.
*A61H 15/00* (2006.01)

(52) U.S. Cl. ..... 601/99; 601/100; 601/102; 601/103; 601/116

(58) Field of Classification Search ..... 601/15, 601/18, 19, 86–87, 90, 92–95, 97–103, 115–118, 601/122, 126; 606/240–242; 5/617, 618
See application file for complete search history.

(56) References Cited

U.S. PATENT DOCUMENTS

| | | | | |
|---|---|---|---|---|
| 4,422,449 | A | 12/1983 | Hamabe | |
| 4,723,537 | A * | 2/1988 | Parker, Jr. | 606/242 |
| 5,137,016 | A * | 8/1992 | Yamasaki et al. | 601/116 |
| 5,179,940 | A | 1/1993 | Barreiro | |
| 6,454,732 | B1 | 9/2002 | Lee | |
| 6,542,779 | B1 | 4/2003 | Lee | |
| 6,555,798 | B1 | 4/2003 | Lee | |
| 6,629,939 | B1 | 10/2003 | Jikiba | |
| 6,643,551 | B1 | 11/2003 | Park | |
| 2002/0138023 | A1 | 9/2002 | Kume et al. | |
| 2002/0193713 | A1 | 12/2002 | Lee | |
| 2003/0018284 | A1 | 1/2003 | Lim | |

* cited by examiner

*Primary Examiner*—Quang D. Thanh
(74) *Attorney, Agent, or Firm*—Park Law Firm; John K. Park

(57) ABSTRACT

A lie-down massager comprising a first mat with an elongated opening, a sliding member in the first mat hingedly engaged to a base to allow an angular lifting of the first mat from the base, a support downwardly attached to the base, a nut gear rotatably engaged to the support and having a wheel gear along an outer periphery of the nut gear, the wheel gear engaged to a second wheel gear, a shaft gear having a hinge end and a gear end received into the nut gear. A substantially bent rod has an upper end hingedly engaged to the first mat, a lower end hingedly engaged to the hinge end, and a hinge point between the upper end and the lower end, the hinge point hingedly engaged to the base frame, massage bumps carried on top of a rider reciprocating along the elongated opening.

29 Claims, 4 Drawing Sheets

LIE-DOWN MASSAGER

BACKGROUND OF INVENTION

The invention relates generally to a massaging device. More particularly, the present invention relates to an improved lie-down massager enabling a selective mat lifting during a lie-down massage by use of an elongated nut gear and roller bearings.

A requirement of a lie-down massager is capability of efficiently treating bodily malfunctions such as back pain and gastrointestinal weakness by applying a therapeutic massaging treatment along the back and neck of a patient lying down on the massager whose massaging bumps move horizontally and vertically along the patients spinal cord and neck.

A demand is a convenient and reliable mat lifting mechanism that allows the patient on the massager to easily lift or lower the massage mat so that the person lying on the massager can take a massage with further relaxation, for example, while watching television. Another demand is to adopt a reliable mechanism demonstrating a steady and robust therapeutic effects while stabilizing the horizontal and vertical movement of the massaging bumps.

SUMMARY OF INVENTION

The present invention is contrived to overcome the conventional disadvantages. Accordingly, an object of the invention is to provide a lie-down massager enabling a person lying on the massager to selectively lift a mat portion for an additional activity, such as watching television, during the lie-down massage.

Another object is to minimize parts required for mat lifting by adopting a substantially bent connecting rod and an elongated nut gear while decreasing breakdown rate, thereby enabling patients to receive a steady and robust massaging therapy with the massaging bumps applied to and along their backs and necks. A further object is to improve product reliability and customer satisfaction by mechanically stabilizing the mat lifting mechanism by adopting a combination gear mechanism.

To achieve these and other objects, the lie-down massager according to the present invention comprises a base frame, an upper frame having a first mat portion and a second mat portion whose first mat portion has an elongated top panel with an elongated opening formed centrally and lengthwisely through the elongated top panel. A sliding member is provided in the first mat portion to make a lengthwisely slidable reciprocation, and the first mat portion is hingedly engaged to the base frame therebelow to allow an angular lifting of the first mat portion from the base frame and relative to the second mat portion when required.

In a preferred mode, a support is downwardly attached to the base frame, and an elongated nut type gear is rotatably engaged to and propped by the support and having a first wheel gear formed on and along an outer periphery of the nut type gear, where the first wheel is gearedly engaged to a second wheel gear powered by a motor fixed to the base frame. Here, the rotatable engagement of the nut type gear to the support is implemented by a bearing member.

A shaft gear is provided to have a hinge end and a gear end gearedly received into the nut type gear. A substantially bent connecting rod includes an upper end hingedly engaged to the sliding member, a lower end hingedly engaged to the hinge end of the shaft gear, and a hinge point between the upper end and the lower end, wherein the hinge point is hingedly engaged to the base frame. In this construction, massage bumps carried on top of a rider are provided in the first mat portion so that the rider makes a reciprocal movement along the elongated opening of the first mat portion, and a pad covering the massage bumps and the elongated opening.

In an embodiment, the massager further comprises a pair of roller coasters parallel to each other and attached to the first mat portion with the roller coasters each having a substantially waved top surface so that a guide roller formed on each side of the rider guides the rider to reciprocate on and along the waved top surface.

Alternately, the bearing member comprises a first roller bearing engaged between the support and the outer periphery of the nut type gear, and a second roller bearing engaged among the support, the first wheel gear, and the outer periphery of the nut type gear. The first roller bearing may be substantially tapered. Further, the bearing member may include a pair of side rack gears parallel to each other and lengthwisely provided in the first mat portion, and a roller gear perpendicular to the side rack gears with the roller gear rollably connected to the rider and rotatably mounted on the side rack gears. The bearing member may selective include a pair of pulleys linked by a rope and respectively mounted in a front end portion and a rear end portion of the first mat portion so that a predetermined portion of the rope is fixedly attached to the rider so that the pulley rotation enables the rider to generate the reciprocal movement along the elongated top opening.

The massage bumps are roller balls partitioned to first and second pairs with the first pair bumps aligned parallel to the second pair bumps. Preferably, at least one stationary bump is provided between the roller balls. Also, first and second bump holders are provided for propping and maintaining the first and second pair bumps on top of the rider, and the first and second bump holders are tapered toward each lower end thereof. There are further provided a first engagement member to rockingly engage the lower ends of the bump holders to the rider, and a second engagement member to rollingly engage the massage bumps thereto. The massage bumps may each include a heater which is a heating lamp generating heat and infrared rays.

Advantages of the present inventions are numerous. Most of all, the first mat portion of the lie-down massager is hingedly lifted by a person lying on the massager to allow an additional activity, such as watching television, during the lie-down massage, thereby maximizing customer satisfaction. Further, the combination gear mechanism adopting the substantially bent connecting rod and the elongated nut gear minimizes required parts for the mat lifting while decreasing breakdown rate, thereby enabling patients to receive a steady and robust massaging therapy in a variety of postures with the massaging bumps applied to and along their backs and necks. In addition, the nut gear releasably receiving the shaft gear serves to mechanically stabilize the mat lifting mechanism in combination with the roller coasters providing an additional lifting, thereby improving product reliability.

Although the present invention is briefly summarized, the full understanding of the invention can be obtained by the following drawings, detailed description and appended claims.

BRIEF DESCRIPTION OF DRAWINGS

These and other-features, aspects and advantages of the present invention will become better understood with reference to the accompanying drawings, wherein.

DETAILED DESCRIPTION

Figure 1:
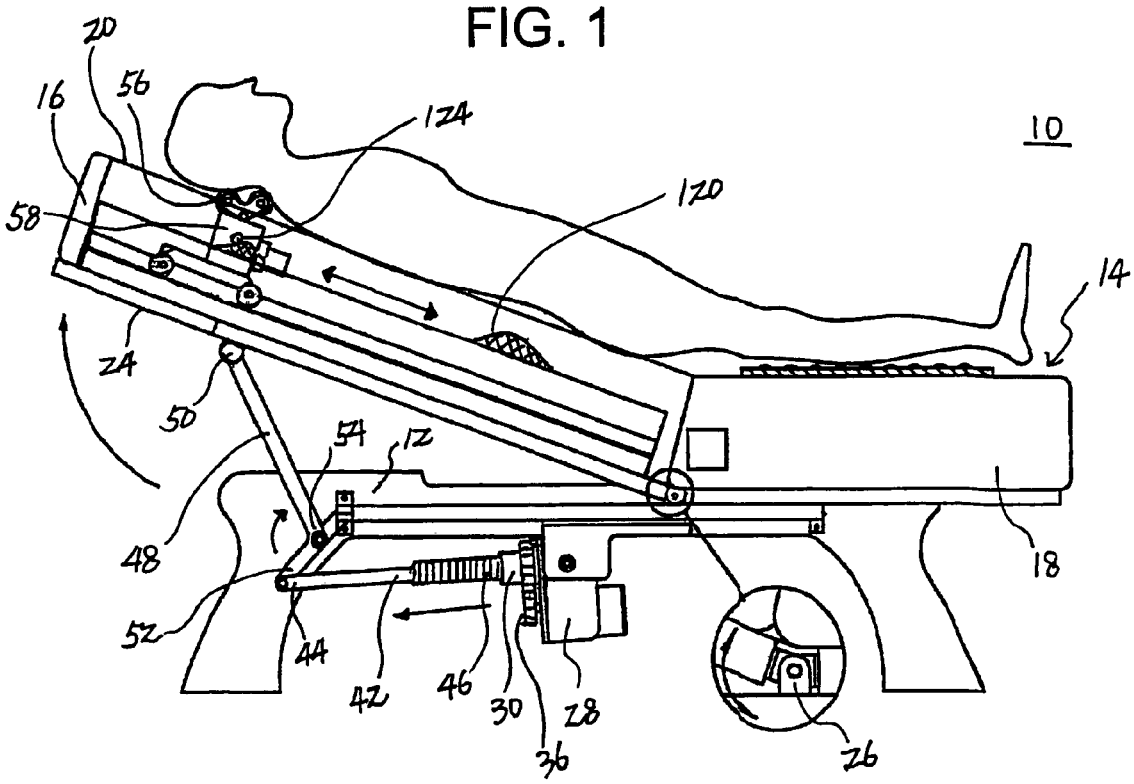
FIG. 1 is a view showing a lie-down massager with a patient being lifted thereon according to the present invention.
Figure 2:
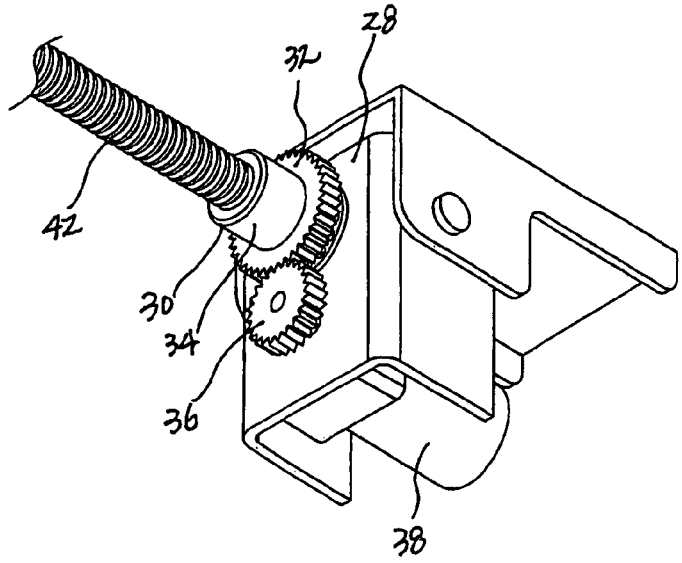
FIG. 2 is a perspective view showing a combination gear mechanism for mat lifting according to the present invention.
Figure 4:
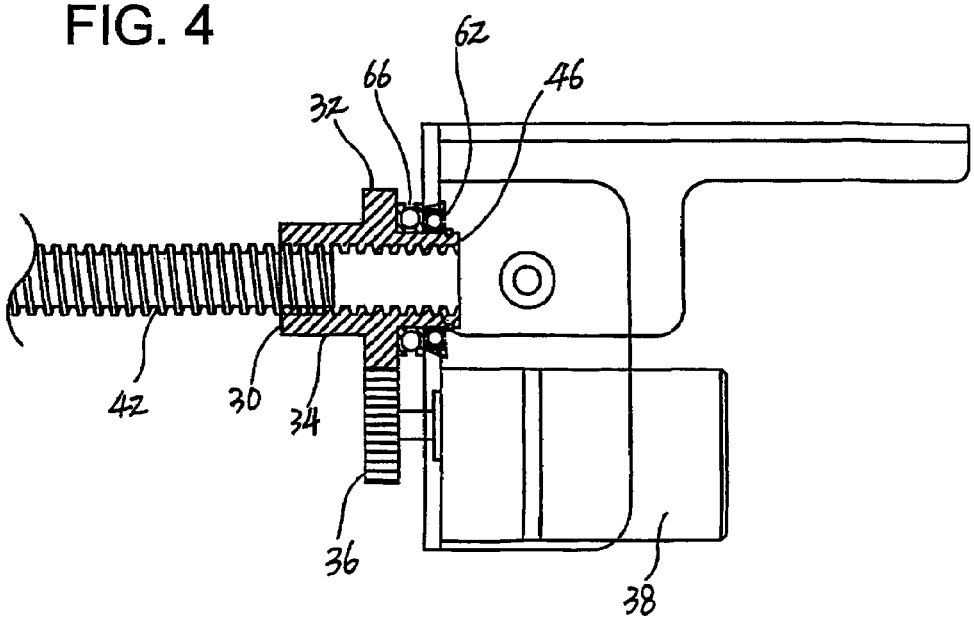
FIG. 4 is a cross-sectional side view of FIG. 2 to further show the nut type gear mechanism.
Figure 5:
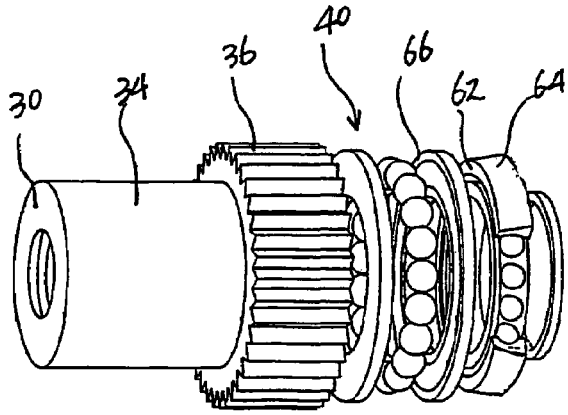
FIG. 5 is a perspective view showing ball bearings applied to the nut type gear.
Figure 6:
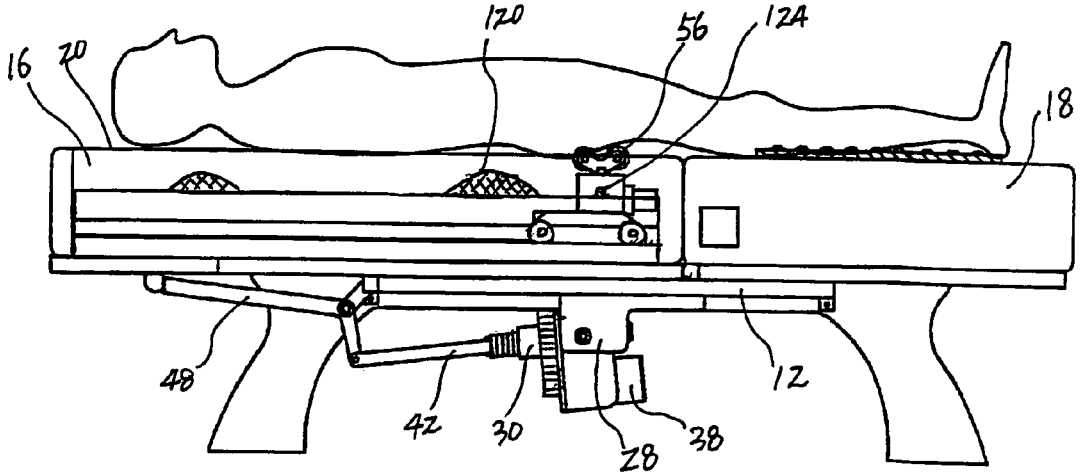
FIG. 6 is a view showing the lie-down massager with a patent lying without mat lifting.
Figure 7:
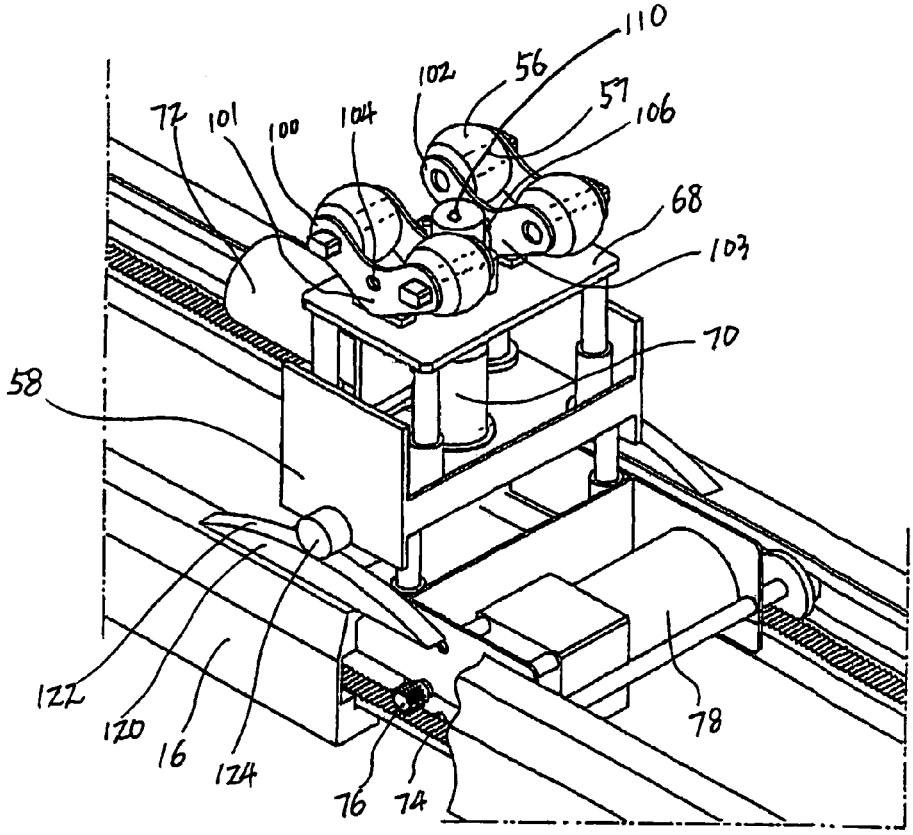
FIG. 7 is a partial perspective view showing an embodiment of the present invention to illustrate a rack gear mechanism.
Figure 8:
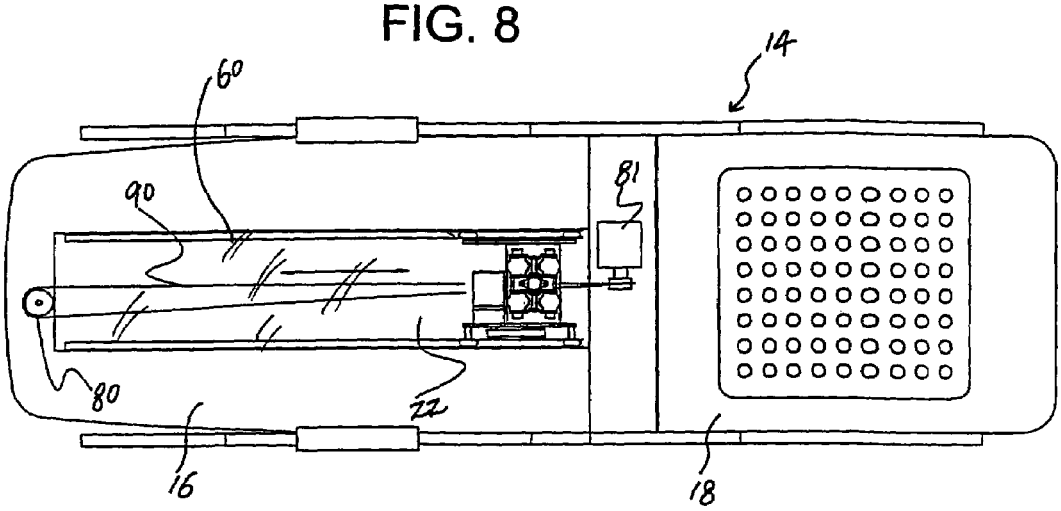
FIG. 8 is a plan view of the lie-down massager showing another embodiment of the present invention.

FIG. 1 shows a mat lifting mechanism with a patient lying on a lie-down massager 10 being lifted, FIGS. 2–5 each illustrate the mat lifting mechanism, and FIGS. 6–8 each detail preferred embodiments. As shown therein, the lie-down massager 10 according to the present invention includes a base frame 12 and an upper frame 14 having a first mat portion 16 and a second mat portion 18. The first mat portion 16 has an elongated top panel 20 with an elongated opening 22 formed centrally and lengthwisely through the elongated top panel 20. A sliding member 24 is provided in the first mat portion 16 to make a lengthwisely slidable reciprocation when required. The first mat portion 16 is hingedly engaged to the base frame 12 therebelow to allow an angular lifting of the first mat portion 16 from the base frame 12 and relative to the second mat portion 18 when required.

A first hinge 26 may be provided either on top of the base frame 12 or aside the base frame 12. The first hinge 26 serves to rotatably link the first mat portion 16, the second mat portion 18 and the base frame 12. That is, the first hinge 26 allows the angular lifting operation of the first mat portion 16 relative to the base frame 12 and the second mat portion 18.

Figure 3:
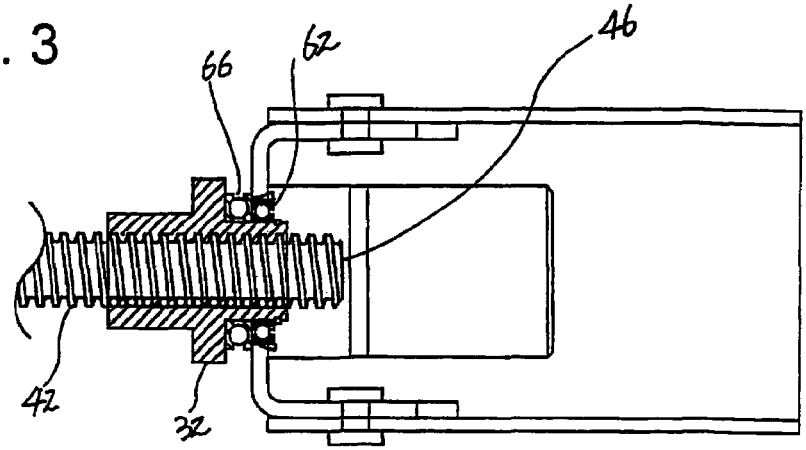
FIG. 3 is a cross-sectional top view of FIG. 2 to show a nut type gear mechanism.

A support 28 is downwardly attached to the base frame 12. An elongated nut type gear 30 is rotatably engaged to and propped by the support 28. A first wheel gear 32 is formed on and along an outer periphery 34 of the nut type gear 30. The first wheel gear 32 is gearedly engaged to a second wheel gear 36 powered by a motor 38 fixed either to the base frame 12 or to the support 28. In this construction, the rotatable engagement of the nut type gear 30 to the support 28 is implemented by a bearing member 40 as illustrated in FIGS. 3–5:

A shaft gear 42 is provided to have a hinge end 44 and a gear end 46. The gear end 46 is gearedly received into the nut type gear 30. Meanwhile, a substantially bent connecting rod 48 is provided to have an upper end 50 hingedly engaged to the sliding member 24, a lower end 52 hingedly engaged to the hinge end 44 of the shaft gear 42, and a hinge point 54 between the upper end 50 and the lower end 52 of the connecting rod 48. Here, the hinge point 54 is hingedly engaged to the base frame 12.

Massage bumps 56 are carried on top of a rider 58 provided in the first mat portion 16. The rider 58 makes a reciprocal movement along the elongated opening 22 of the first mat portion 16 of the upper frame 14. A pad 60 is selectively provided to cover the massage bumps 56 and the elongated opening 22 of the first mat portion 16 of the upper frame 14.

For a better performance, the bearing member 40 comprises a first roller bearing 62 engaged between the support 28 and the outer periphery 34 of the nut type gear 30. The outer periphery 64 of the first roller bearing 62 may be substantially tapered to further stabilize the rotatable engagement of the nut gear 30 to the support 28. Selectively, the bearing member may further comprise a second roller bearing 66 engaged among the support 28, the first wheel gear 32, and the outer periphery 34 of the nut type gear 30.

In an embodiment, a lifter 68 is provided to carry the massage bumps 56 on top thereof. Here, the lifter 68 is liftedly engaged to the rider 58 therebelow to make a vertical reciprocation relative to the rider 58 in accordance with a lifting member 70 provided between the lifter 68 and the rider 58. The lifting member 70 is activated by a motor 72 so that the activation of the motor 72 enables a vertical reciprocation of the lifter 68 relative to the rider 58, whereby the massage bumps 56 conduct massaging operation along the back, neck and waist of the patient lying down on the massager 10 in accordance with the horizontal reciprocation of the rider 58 and the concurrent vertical reciprocation of the lifter 68.

Specifically, the massage bumps 56 are carried either on the rider 58 when the lifter 68 is not provided or on the lifter 68 when the lifter 68 is provided between the massage bumps 56 and the rider 58, and the lifting member 70 activated by the motor 72 controls strength of bump massaging on and along the neck, back and waist of the patient lying on the massager 10.

As further shown in FIGS. 6 and 7, in order to implement the horizontal reciprocation of the rider 58, the massager 10 includes a pair of side rack gears 74 parallel to each other and lengthwisely provided in the first mat portion 16, and a roller gear 76 perpendicular to the side rack gears 74. Here, the roller gear 76 is rollably connected to the rider 58 and rotatably mounted on the side rack gears 74. The roller gear 74 is powered by a roller motor 78.

Figure 9:
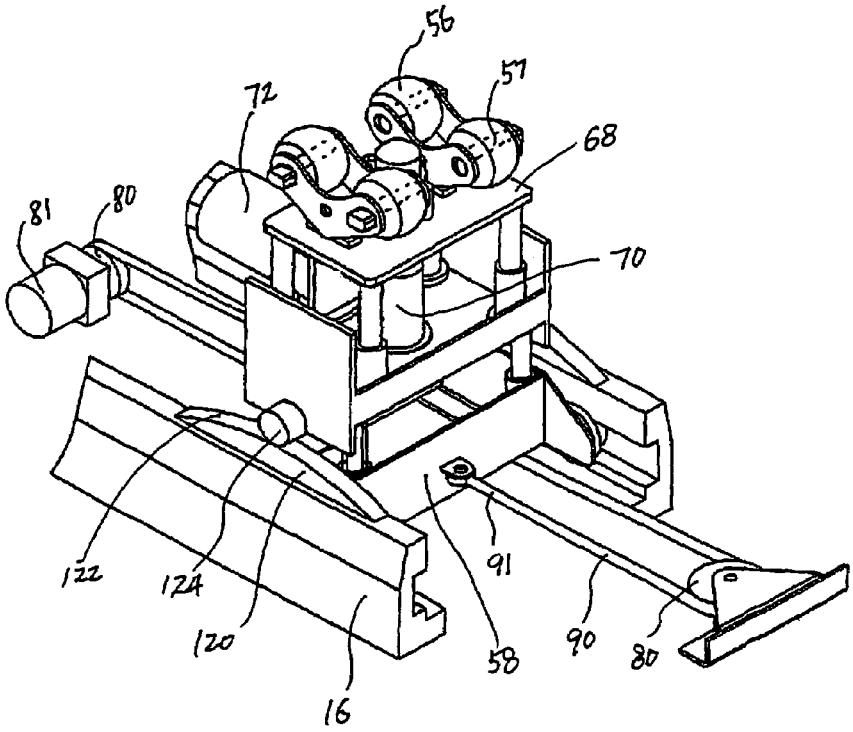
FIG. 9 is a perspective view showing the embodiment in FIG. 8 to illustrate a pulley-applied horizontal reciprocation.

Referring further to FIGS. 8 and 9, the massager 10 may alternately include a pair of pulleys 80 for the horizontal reciprocation of the rider 58. That is, the pulleys 80 are linked by a rope 90 and respectively mounted in a front end portion 92 and a rear end portion 94 of the first mat portion 16 so a predetermined portion 91 of the rope 90 is fixedly attached to the rider 58 so that the pulley rotation enables the rider 58 to generate the reciprocal movement along the elongated top opening 22. Here, the pulley operation is activated by a pulley motor 81.

In a preferred version, the massage bumps 56 are preferably partitioned to first and second pairs so that the first pair bumps are aligned parallel to the second pair bumps. It is also recommended that the massage bumps 56 are formed of roller balls which are preferably formed of precious stone such as jade or gem. For a better massaging result, the massage bumps 56 may each include a heater 57 preferably in form of a heating lamp. Selectively, the heating lamp for the heater 57 may be formed to generate heat and infrared rays to maximize therapeutic effects.

In a preferred mode, first and second bump holders 100, 102 are provided to prop and maintain the first and second pair bumps on top of the rider 58 or the lifter 68. The first and second bump holders 100, 102 are preferably tapered toward each lower end 101, 103 thereof. To improve flexibility of engagement between the bump holders 100, 102 and the bumps 56, and between the bump holders 100, 102 and the rider 58 or the lifter 68, there are provided first and second engagement members 104, 106. The first engagement member 104 is provided to rockingly engage the lower ends 101, 103 of the bump holders 100, 102 on top of the rider 58 or the lifter 68. The second engagement member 106 is provided to rollingly engage the massage bumps 56 to itself.

The engagement members 104, 106 each may be a bolt, a roller, or other engagement tool. In this bump-holder mechanism, the bump holders 100, 102 flexibly engage the massage bumps 56 to the rider 58 or the lifter 68 so that the massage bumps 56 rollingly massage the waist, back and neck of the patient lying on the first mat portion 16 of the upper frame 14 while evenly spreading the massaging power along the bodily portions being pushed up by the massage bumps 56. That is, the rocking mechanism of the bump holders 100, 102 enables the massage bumps 56 to smoothly follow the curvature of a spinal cord of the patient lying on the first mat portion 16 while each of the massage bumps 56 evenly delivers the massaging power to the patients bodily portions being massaged.

Selectively, at least one stationary bump 110 is provided between the roller balls 56 to provide a solid massage function relative to the rocking massage of the massage bumps 56. Consequently, the massage bumps 56 carried on top of the rider 58 or the lifter 68 serve to make a vertical reciprocation in accordance with the lifting member 70 activated by the motor 71.

In order to further enhance massaging effect, the massager 10 includes a pair of roller coasters 120 parallel to each other and attached to the first mat portion 16. The roller coasters 120 each have a substantially waved top surface 122. In this construction, a guide roller 124 formed on each side of the rider 58 guides the rider 58 to reciprocate on and along the waved top surface 122 of the roller coasters 120.

As discussed above, an advantage of the present inventions is that the first mat portion 16 of the lie-down massager 10 is hingedly lifted by a person lying on the massager to allow an additional activity, such as watching television, during the lie-down massage, thereby maximizing customer satisfaction.

Further, the combination gear mechanism adopting the substantially bent connecting rod 48 and the elongated nut gear 30 minimizes required parts for the mat lifting while decreasing breakdown rate, thereby enabling patients to receive a steady and robust massaging therapy in a variety of postures with the massaging bumps 56 applied to and along their waists, backs and necks. In addition, the nut gear 30 releasably receiving the shaft gear 42 serves to mechanically stabilize the mat lifting mechanism in combination with the roller coasters 120 providing an additional lifting, thereby improving product reliability.

Although the invention has been described in considerable detail, other versions are possible by converting the aforementioned construction. Therefore, the scope of the invention shall not be limited by the specification specified above and the appended claims.

The invention claimed is:

1. A lie-down massager, comprising:

a) a base frame;

b) an upper frame having a first mat portion and a second mat portion, wherein the first mat portion has an elongated top panel with an elongated opening formed centrally and lengthwisely through the elongated top panel, wherein a sliding member is provided in the first mat portion to make a lengthwisely slidable reciprocation, wherein the first mat portion is hingedly engaged to the base frame therebelow to allow an angular lifting of the first mat portion from the base frame and relative to the second mat portion when required;

c) a support downwardly attached to the base frame;

d) an elongated nut type gear rotatably engaged to and propped by the support and having a first wheel gear formed on and along an outer periphery of the nut type gear, wherein the first wheel gear is gearedly engaged to a second wheel gear powered by a motor fixed to the base frame, wherein the rotatable engagement of the nut type gear to the support is implemented by a bearing member;

e) a shaft gear having a hinge end and a gear end, wherein the gear end is gearedly received into the nut type gear;

f) a substantially bent connecting rod having an upper end hingedly engaged to the sliding member, a lower end hingedly engaged to the hinge end of the shaft gear, and a hinge point between the upper end and the lower end, wherein the hinge point is hingedly engaged to the base frame;

g) massage bumps carried on top of a rider provided in the first mat portion, wherein the rider makes a reciprocal movement along the elongated opening of the first mat portion; and h) a pad covering the massage bumps and the elongated opening.

2. The lie-down massager of claim 1 wherein the bearing member comprises a first roller bearing engaged between the support and the outer periphery of the nut type gear.

3. The lie-down massager of claim 2 wherein an outer periphery of the first roller bearing is substantially tapered.

4. The lie-down massager of claim 2 wherein the bearing member further comprises a second roller bearing engaged among the support, the first wheel gear, and the outer periphery of the nut type gear.

5. The lie-down massager of claim 1 wherein the massage bumps are roller balls partitioned to first and second pairs, wherein the first pair bumps are aligned parallel to the second pair bumps.

6. The lie-down massager of claim 1 wherein the massage bumps are roller balls partitioned to first and second pairs, wherein at least one stationary bump is provided between the roller balls.

7. The lie-down massager of claim 6 further comprising:

a) first and second bump holders propping and maintaining the first and second pair bumps on top of the rider, wherein the first and second bump holders are tapered toward each lower end thereof;

b) a first engagement member to rockingly engage the lower ends of the bump holders to the rider; and c) a second engagement member to rollingly engage the massage bumps thereto.

8. The lie-down massager of claim 1 wherein the massage bumps each include a heater, wherein the heater is a heating lamp generating heat and infrared rays.

9. A lie-down massager, comprising:

a) a base frame;

b) an upper frame having a first mat portion and a second mat portion, wherein the first mat portion has an elongated top panel with an elongated opening formed centrally and lengthwisely through the elongated top panel, wherein a sliding member is provided in the first mat portion to make a lengthwisely slidable reciprocation, wherein the first mat portion is hingedly engaged to the base frame therebelow to allow an angular lifting of the first mat portion from the base frame and relative to the second mat portion when required;

c) a support downwardly attached to the base frame;

d) an elongated nut type gear rotatably engaged to and propped by the support and having a first wheel gear formed on and along an outer periphery of the nut type gear, wherein the first wheel gear is gearedly engaged to a second wheel gear powered by a motor fixed to the base frame, wherein the rotatable engagement of the nut type gear to the support is implemented by a bearing member;

e) a shaft gear having a hinge end and a gear end, wherein the gear end is gearedly received into the nut type gear;

f) a substantially bent connecting rod having an upper end hingedly engaged to the sliding member, a lower end hingedly engaged to the hinge end of the shaft gear, and a hinge point between the upper end and the lower end, wherein the hinge point is hingedly engaged to the base frame;

g) massage bumps carried on top of a rider provided in the first mat portion, wherein the rider makes a reciprocal movement along the elongated opening of the first mat portion;

h) a pair of roller coasters parallel to each other and attached to the first mat portion, wherein the roller coasters each have a substantially waved top surface, wherein a guide roller formed on each side of the rider guides the rider to reciprocate on and along the waved top surface; and i) a pad covering the massage bumps and the elongated opening.

10. The lie-down massager of claim 9 wherein the bearing member comprises a first roller bearing engaged between the support and the outer periphery of the nut type gear.

11. The lie-down massager of claim 10 wherein an outer periphery of the first roller bearing is substantially tapered.

12. The lie-down massager of claim 10 wherein the bearing member further comprises a second roller bearing engaged among the support, the first wheel gear, and the outer periphery of the nut type gear.

13. The lie-down massager of claim 9 wherein the massage bumps are roller balls partitioned to first and second pairs, wherein the first pair bumps are aligned parallel to the second pair bumps.

14. The lie-down massager of claim 9 wherein the massage bumps are roller balls partitioned to first and second pairs, wherein at least one stationary bump is provided between the roller balls.

15. The lie-down massager of claim 14 further comprising:

a) first and second bump holders propping and maintaining the first and second pair bumps on top of the rider, wherein the first and second bump holders are tapered toward each lower end thereof;

b) a first engagement member to rockingly engage the lower ends of the bump holders to the rider; and c) a second engagement member to rollingly engage the massage bumps thereto.

16. The lie-down massager of claim 9 wherein the massage bumps each include a heater, wherein the heater is a heating lamp generating heat and infrared rays.

17. The lie-down massager of claim 9 further comprising a pair of pulleys linked by a rope and respectively mounted in a front end portion and a rear end portion of the first mat portion, wherein a predetermined portion of the rope is fixedly attached to the rider so that the pulley rotation enables the rider to generate the reciprocal movement along the elongated top opening.

18. The lie-down massager of claim 9 further comprising:

a) a pair of side rack gears parallel to each other and lengthwisely provided in the first mat portion; and b) a roller gear perpendicular to the side rack gears, wherein the roller gear is rollably connected to the rider and rotatably mounted on the side rack gears.

19. A lie-down massager, comprising:

a) a base frame;

b) an upper frame having a first mat portion and a second mat portion, wherein the first mat portion has an elongated top panel with an elongated opening formed centrally and lengthwisely through the elongated top panel, wherein a sliding member is provided in the first mat portion to make a lengthwisely slidable reciprocation, wherein the first mat portion is hingedly engaged to the base frame therebelow to allow an angular lifting of the first mat portion from the base frame and relative to the second mat portion when required;

c) a support downwardly attached to the base frame;

d) an elongated nut type gear rotatably engaged to and propped by the support and having a first wheel gear formed on and along an outer periphery of the nut type gear, wherein the first wheel gear is gearedly engaged to a second wheel gear powered by a motor fixed to the base frame, wherein the rotatable engagement of the nut type gear to the support is implemented by a bearing member;

e) a shaft gear having a hinge end and a gear end, wherein the gear end is gearedly received into the nut type gear;

f) a substantially bent connecting rod having an upper end hingedly engaged to the sliding member, a lower end hingedly engaged to the hinge end of the shaft gear, and a hinge point between the upper end and the lower end, wherein the hinge point is hingedly engaged to the base frame;

g) a rider provided in the first mat portion to make a reciprocal movement along the elongated opening of the first mat portion;

h) massage bumps carried on top of a lifter, wherein the lifter is liftedly engaged to the rider therebelow to make a vertical reciprocation relative to the rider in accordance with a lifting member provided between the lifter and the rider;

i) a pair of roller coasters parallel to each other and attached to the first mat portion, wherein the roller coasters each have a substantially waved top surface, wherein a guide roller formed on each side of the rider guides the rider to reciprocate on and along the waved top surface; and j) a pad covering the massage bumps and the elongated opening.

20. The lie-down massager of claim 19 wherein the bearing member comprises a first roller bearing engaged between the support and the outer periphery of the nut type gear.

21. The lie-down massager of claim 20 wherein an outer periphery of the first roller bearing is substantially tapered.

22. The lie-down massager of claim 20 wherein the bearing member further comprises a second roller bearing engaged among the support, the first wheel gear, and the outer periphery of the nut type gear.

23. The lie-down massager of claim 19 wherein the massage bumps are roller balls partitioned to first and second pairs, wherein the first pair bumps are aligned parallel to the second pair bumps.

24. The lie-down massager of claim 19 wherein the massage bumps are roller balls partitioned to first and second pairs, wherein at least one stationary bump is provided between the roller balls.

25. The lie-down massager of claim 24 further comprising:

a) first and second bump holders propping and maintaining the first and second pair bumps on top of the rider, wherein the first and second bump holders are tapered toward each lower end thereof;

b) a first engagement member to rockingly engage the lower ends of the bump holders to the rider; and c) a second engagement member to rollingly engage the massage bumps thereto.

26. The lie-down massager of claim 19 wherein the massage bumps each include a heater, wherein the heater is a heating lamp generating heat and infrared rays.

27. The lie-down massager of claim 19 wherein the lifting member is motor-activated.

28. The lie-down massager of claim 19 further comprising a pair of pulleys linked by a rope and respectively mounted in a front end portion and a rear end portion of the first mat portion, wherein a predetermined portion of the rope is fixedly attached to the rider so that the pulley rotation enables the rider to generate the reciprocal movement along the elongated top opening.

29. The lie-down massager of claim 19 further comprising:

a) a pair of side rack gears parallel to each other and lengthwisely provided in the first mat portion; and b) a roller gear perpendicular to the side rack gears, wherein the roller gear is rollably connected to the rider and rotatably mounted on the side rack gears.

* * * * *